US005804534A

United States Patent [19]

Zaki

[11] Patent Number: 5,804,534

[45] Date of Patent: Sep. 8, 1998

[54] HIGH PERFORMANCE DUAL MODE MICROWAVE FILTER WITH CAVITY AND CONDUCTING OR SUPERCONDUCTING LOADING ELEMENT

[75] Inventor: Kawthar Abdelhamid Zaki, Potomac, Md.

[73] Assignee: University of Maryland, College Park, Md.

[21] Appl. No.: 633,705

[22] Filed: Apr. 19, 1996

[51] Int. Cl.[6] ..... H01P 1/201; H01B 12/02

[52] U.S. Cl. ..... 505/210; 505/700; 505/866; 333/202; 333/212; 333/99.005

[58] Field of Search ..... 333/202, 219, 333/212, 209, 230, 995; 505/210, 700, 701, 866

[56] References Cited

U.S. PATENT DOCUMENTS

| | | | |
|---|---|---|---|
| 3,697,898 | 10/1972 | Blachier et al. | 333/21 A |
| 3,969,682 | 7/1976 | Rossum | 330/85 |
| 4,019,161 | 4/1977 | Kimura et al. . | |
| 4,135,133 | 1/1979 | Mok . | |
| 4,142,164 | 2/1979 | Nishikawa et al. . | |
| 4,143,344 | 3/1979 | Nishikawa et al. | 333/202 |
| 4,180,787 | 12/1979 | Pfitzenmaier | 333/212 |
| 4,184,130 | 1/1980 | Nishikawa et al. | 333/206 |
| 4,241,322 | 12/1980 | Johnson et al. | 333/202 |
| 4,410,865 | 10/1983 | Young et al. | 333/208 |
| 4,453,146 | 6/1984 | Fiedziuszko | 333/212 |
| 4,488,132 | 12/1984 | Collins et al. | 333/229 |
| 4,489,293 | 12/1984 | Fiedziuszko | 333/202 |
| 4,513,264 | 4/1985 | Dorey et al. | 333/212 |
| 4,544,901 | 10/1985 | Rhodes et al. | 333/212 |
| 4,571,563 | 2/1986 | Cameron | 333/212 |
| 4,652,591 | 3/1987 | Londrigan . | |
| 4,652,843 | 3/1987 | Tang et al. | 333/212 |
| 4,652,844 | 3/1987 | Brambilla | 333/212 |
| 4,675,630 | 6/1987 | Tang et al. | 333/208 |
| 4,721,933 | 1/1988 | Schwartz et al. | 333/212 |
| 4,736,173 | 4/1988 | Basil, Jr. et al. | 333/229 |
| 4,996,188 | 2/1991 | Kommrusch | 333/202 X |
| 5,012,211 | 4/1991 | Young et al. | 333/212 |
| 5,083,102 | 1/1992 | Zaki | 333/212 |
| 5,179,074 | 1/1993 | Friedziuszko et al. | 333/202 X |
| 5,268,659 | 12/1993 | Zaki et al. | 333/209 |
| 5,391,543 | 2/1995 | Higaki et al. | 505/210 |
| 5,459,123 | 10/1995 | Das | 333/212 |

OTHER PUBLICATIONS

Robert E. Collin, "Field Theory of Guided Waves", McGraw–Hill Book Company, Inc. pp. 289 & 525 Copyright 1960.

*Primary Examiner*—Benny T. Lee
*Attorney, Agent, or Firm*—Nikaido, Marmelstein, Murray & Oram LLP

[57] ABSTRACT

A microwave filter has at least one resonator with a cavity and a conducting or superconducting loading element inside the cavity. The resonator also has first and second tuning screws at right angles and a mode coupling screw at 45° angles to both tuning screws. This filter can achieve a high Q in a small size.

16 Claims, 8 Drawing Sheets

Fig.5A
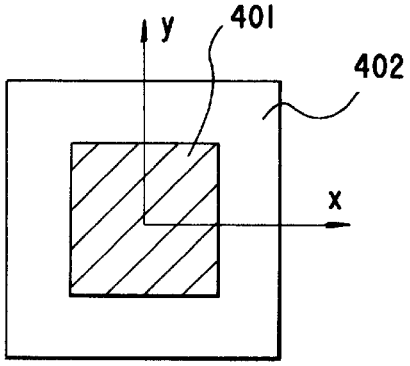
Fig.5B
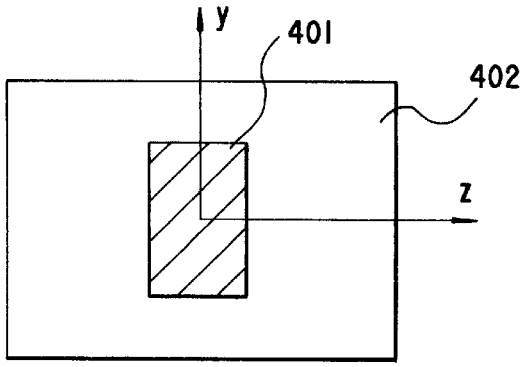
Fig.6A
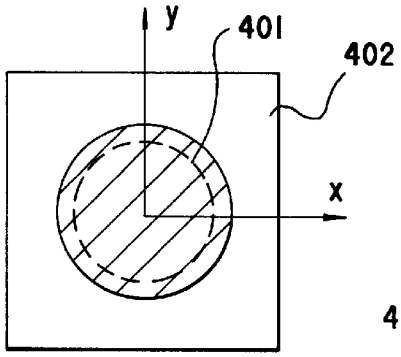
Fig.6B
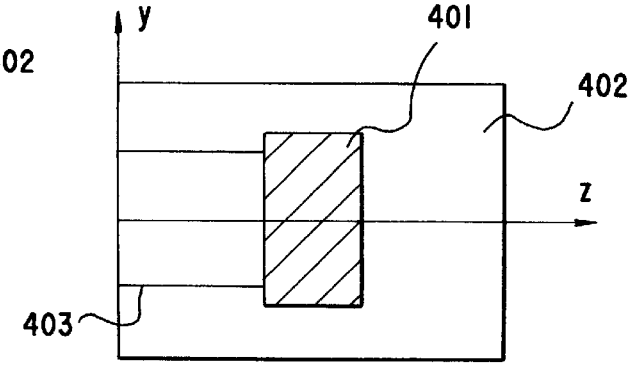
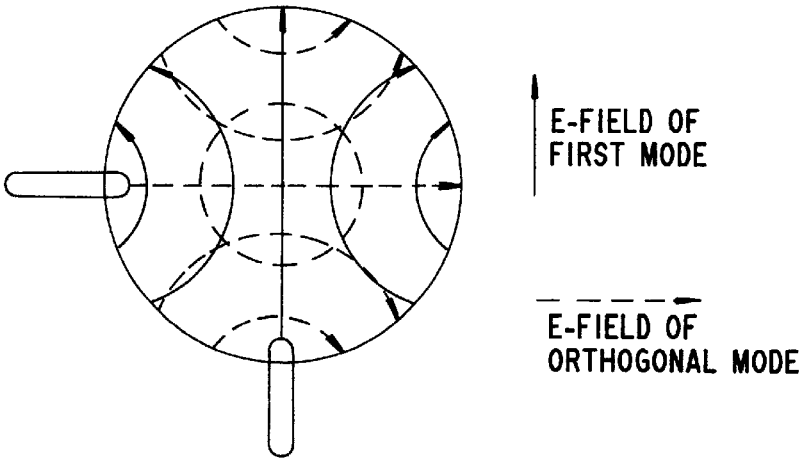
Fig.7

HIGH PERFORMANCE DUAL MODE MICROWAVE FILTER WITH CAVITY AND CONDUCTING OR SUPERCONDUCTING LOADING ELEMENT

FIELD OF THE INVENTION

The invention is directed to a high performance microwave filter for transmitter or receiver applications.

BACKGROUND OF THE INVENTION

High performance microwave filters are needed in transmitter and receiver applications in communications systems including wireless mobile satellite and other terrestrial networks. In addition to maintaining their high performance (sharp selectivity, low in band insertion loss, flat group delay, and high out of band rejection) over extreme environmental conditions (temperature extremes, shock and vibration), the filters must occupy minimum volume and have small weight, in addition to low cost.

Many of the above qualities are met by a class of filters consisting of either empty waveguide resonators or dielectric loaded waveguide cavities. The empty waveguide resonators using single or dual mode cavities are described in U.S. Pat. No. 3,697,898 to Blachier et al., U.S. Pat. No. 3,969,682 to Williams et al., U.S. Pat. No. 4,060,779 to Atia et al., U.S. Pat. No. 4,135,133 to Mok, and U.S. Pat. No. 4,180,787 to Pfitzenmair. Dielectric loaded resonator filters using single, dual or triple mode resonators are described in U.S. Pat. No. 4,019,161 to Wakino et al., U.S. Pat. Nos. 4,142,164; 4,143,344; 4,184,130 all to Nishikawa et al., U.S. Pat. No. 4,241,322 to Johnson et al., U.S. Pat. No. 4,489,293 to Fiedzuiszko, U.S. Pat. Nos. 4,652,843 and 4,675,630 both to Tang et al., and U.S. Pat. Nos. 5,083,102 and 5,268,659 both to Zaki.

The following patents are also of interest:

4,410,865 to Young et al, issued Oct. 18, 1983;

4,488,132 to Collins et al, issued Dec. 11, 1984;

4,453,146 to Fiedzuiszko, issued Jun. 5, 1984;

4,513,264 to Dorey et al, issued Apr. 23, 1985;

4,544,901 to Rhodes et al, issued Oct. 1, 1985;

4,571,563 to Cameron, issued Feb. 18, 1986;

4,652,591 to Kobayashi, issued Feb. 10, 1987;

4,652,844 to Brambilla, issued Mar. 24, 1987;

4,721,933 to Schwartz et al, issued Jan. 26, 1988;

4,736,173 to Basi, Jr. et al, issued Apr. 5, 1988;

5,012,211 to Young et al, issued Apr. 30, 1991; and 5,391,543 to Higaki et al, issued Feb. 21, 1995.

The disclosures of all of the patents cited above are hereby incorporated into this disclosure by reference.

SUMMARY OF THE INVENTION

The principal purpose (or objective) of the present invention is the provision of a microwave filter having reduced dimensions and weight as compared to prior art filters of comparable performance.

A second purpose of the present invention is the provision of a microwave filter which can readily realize complex filter functions involving several or many resonant elements with cross-couplings among these resonators.

A third purpose of the present invention is the provision of a resonator element having a conducting or superconducting purpose and a conducting or superconducting enclosure (cavity) surrounding the purpose to form a composite resonator.

A fourth purpose of the present invention is the provision of a plurality of such composite resonators together with microwave couplings among them to form a filter capable of realizing a variety of complex filter functions within a compact and lightweight unit.

A fifth purpose of the present invention is the creation in such a composite resonator of simultaneous resonance in each of two orthogonal resonant modes.

A sixth purpose of the present invention is the provision of the ability to separately tune such a composite resonator for each of the orthogonal modes.

A seventh purpose of the present invention is the perturbation of the fields in each resonator such that the resonance excited by fields along a first axis is coupled to and excites fields for resonance along a second orthogonal axis.

An eighth purpose of the present invention is the provision of filters whose frequency response is free from spurious responses over a significantly wider band than corresponding known realizations with similar in-band and close out of band performance.

The above and other purposes of the present invention are achieved by the realization of filter functions in the form of compact filter units which utilize composite resonators operating simultaneously in each of two orthogonal resonant modes. Each of these two orthogonal resonant modes is tunable independently of the other, such that each can be used to realize a separate pole of a filter function. The composite resonators themselves comprise resonator elements made of a conducting or superconducting material and may comprise thin cylindrical, rectangular, ring or doughnut-shaped sections of a conducting (such as silver plated aluminum) or superconducting material (such as copper coated with YBaCuO thick film), together with surrounding cavities which are dimensioned small enough in comparison to the wavelengths involved that such a dimension would be below cut off but for the conducting or superconducting element within the cavity.

Capacitive probes or inductive irises may be used to provide coupling between several such composite resonators, and also to provide input and output coupling for the entire filter unit formed of these composite resonators. By suitably positioning these coupling devices with respect to the two orthogonal resonators modes, it is possible to achieve cross-coupling among any desired resonant modes, such that the filter functions requiring such couplings can easily be realized.

Independent tuning of the orthogonal resonant modes is preferably achieved by the use of a pair of tuning screws projecting inwardly from the cavity wall along axes which are orthogonal to each other. Coupling of resonant modes along either of these two orthogonal axes is preferably achieved by a mode coupling screw projecting into the cavity at an axis which is at an angle of 45° to each of the orthogonal mode axes.

BRIEF DESCRIPTION OF THE DRAWINGS

The above and other detailed and specific purposes, features, and advantages of the present invention will become clearer from a consideration of the following detailed description of preferred embodiments with reference to the associated drawings in which:

FIG. 5A is a longitudinal cross section of one rectangular resonator enclosure with a square or rectangular metallic loading element;

FIG. 5B is a side view cross section of FIG. 5A;

FIG. 6A is a top cross sectional view of a cylindrical solid metallic loading element, in a rectangular enclosure;

FIG. 6B is a side cross sectional view of FIG. 6A;

FIG. 7 is a cross sectional view of the typical resonator in the filter showing the electric field lines of the modes;

DETAILED DESCRIPTION OF A PREFERRED EMBODIMENT

Figure 1:
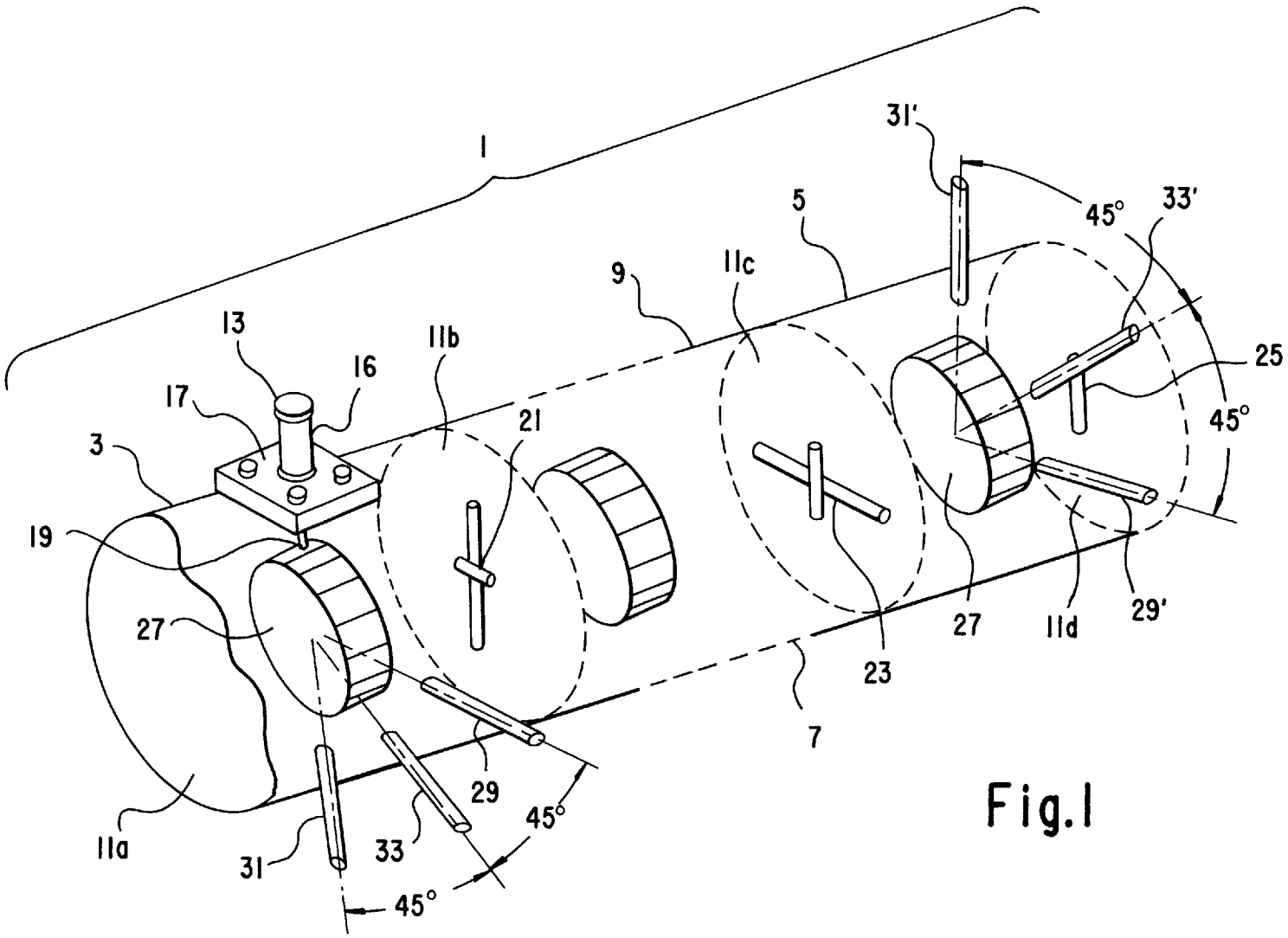
FIG. 1 is a cut away sketch illustrating a dual mode multiple coupled filter illustrating a first embodiment of the present invention in a circular cylindrical structure.

In FIG. 1, a multi-coupled cavity filter 1 embodying features of the present invention is shown. Filter 1 is shown to comprise an input cavity 3, an output cavity 5 and one or more intermediate cavities 7, which are indicated schematically in the broken region between cavities 3 and 5. Cavities 3, 5 and 7 may all be electrically defined within a short length of a cylindrical waveguide 9 by a series of spaced, transversely extending cavity end walls 11*a,* 11*b,* 11*c,* and 11*d.* These end walls and waveguide 9 may all be made of metallic or nonmetallic materials such as aluminum, copper, Invar (a steel alloy containing nickel), or plastics. Furthermore, the interior surface of waveguide 9 and the surfaces of end walls 11*a,* 11*b,* 11*c,* 11*d* may be plated with a highly electrically conductive material such as silver. End walls 11*a,* 11*b,* 11*c,* 11*d* may be joined to the interior wall of waveguide 9 by any known brazing or soldering technique, or by other bonding techniques as appropriate to the materials concerned.

An input coupling device in the form of a coaxial probe assembly 13 is used to couple microwave energy from an external source (not shown) to input cavity 3. As shown in FIG. 1, probe assembly 13 includes a coaxial connector 16, a mounting flange 17, and a capacitive probe 19. Microwave energy coupled to a probe 19 is radiated therefrom into input cavity 3, where electromagnetic fields of a resonant hybrid mode (HE11n) is excited. From input cavity 3, microwave energy is further coupled into intermediate cavities 7 by a first iris 21 of cruciform shape in end wall 11*b,* and from intermediate cavities 7 into output cavity 5; by a second iris 23, also of cruciform shape, in end wall 11*c.* Finally, energy is coupled from output cavity 5 into a waveguide system (not shown) by an output iris 25 of simple slot configuration in end wall 11*d.*

Figure 4A:
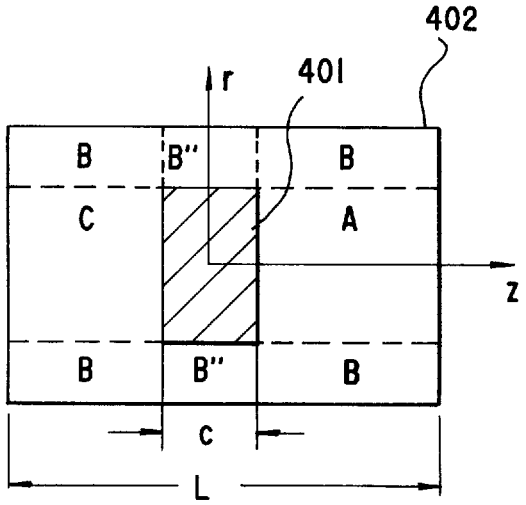
FIG. 4A is a longitudinal cross section of one cylindrical resonator showing a solid metallic cylindrical loading element, within the conducting enclosure.
Figure 4B:
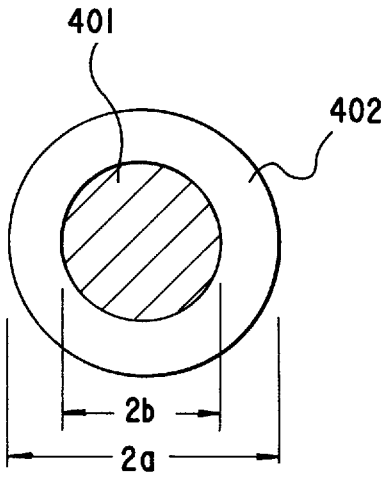
FIG. 4B is a side view cross section of FIG. 4A.
Figure 4C:
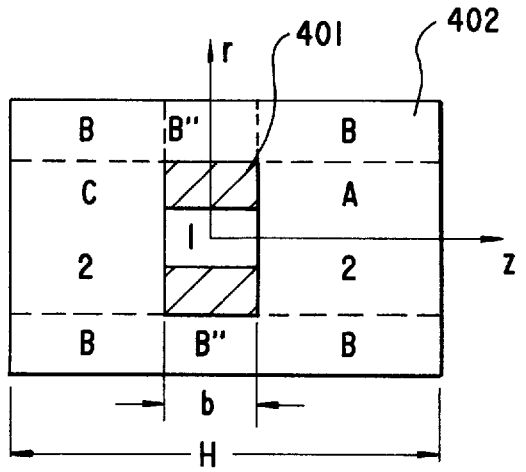
FIG. 4C is a longitudinal cross section of one resonator showing a ring type metallic loading element, within the enclosure.
Figure 4D:
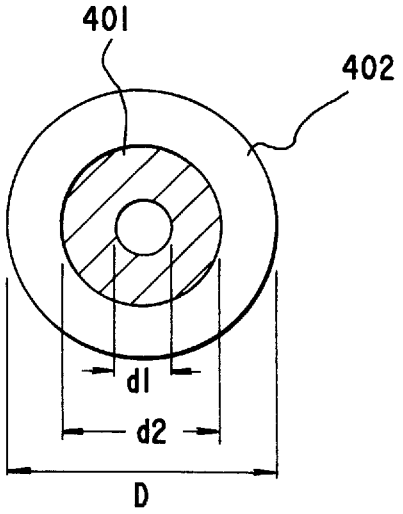
FIG. 4D is a side view cross section of FIG. 4C.

Within each of cavities 3, 5, and 7 is disposed a conducting object shown as cylindrical (but optionally of another shape, e.g. ring or doughnut shaped such as those shown in FIG. 4C and 4D) resonator element 27. The conducting resonator element can be made of a metal such as copper, aluminum or Invar, and copper plated with thin conducting silver, or it can be made of a superconducting material which when cooled yields very low surface resistivity. With careful design, the composite resonators formed by the combination of cavities 3, 5 and 7 and the conductor resonator elements can possess a high Q, while the effect of loading by the conductor elements 27 reduces the physical size of the composite resonator as compared to "empty" cavity resonators designed for the same resonant frequency.

Each composite physical resonator supports two orthogonal independent modes of resonance, which are identical field configurations but rotated at 90° angles to each other. The direction of maximum traverse electric field of one of the modes corresponds to a zero transverse electric field for the orthogonal mode and vice versa. This property of the modes illustrated in FIG. 7 allows the independent fine tuning of the resonance frequency of each mode by a tuning screw oriented in the direction of its maximum electric field. Thus, in FIG. 1 a first tuning screw 29 projects into input cavity 3 along a first axis, which intersects the axis of cavity 3 and resonator element 27 at a substantially 90° angle thereto. A second tuning screw 31 similarly projects into cavity 3 along a second axis which is rotationally displaced from the first axis by 90°. Tuning screws 29 and 31 serve to tune the resonant frequencies of the two orthogonal hybrid $HE_{111}$ modes excited in cavity 3, along the first and second axes respectively. Since the amounts of projection of screws 29 and 31 into the cavity are independently adjustable, each of the two orthogonal modes can be separately tuned to a precisely selected resonant frequency, such that physical composite cavity 3 with its element 27 provide a realization of two poles of the complex filter function.

In order to provide a variable amount of coupling between the two orthogonal resonant modes in cavity 3, a third coupling screw 33 is provided extending into cavity 3 along a third axis or at an angle of 45° to each of tuning screws 29 and 31. Since the total tangential electric field along the direction of screw 33 must be zero, the field components from the two orthogonal modes along that direction must be equal and opposite to each other, thus creating coupling between the two modes. Furthermore, the amount of such coupling is variable by varying the amount of penetration of screw 33 into cavity 3.

Although not shown in FIG. 1, metallic resonator elements 27 can be successfully mounted in cavities 3, 5 and 7 by a variety of insulating mountings which generally take the form of short sections of low loss insulating material such as foam (polystyrene) or Rexolite.

Each of cavities 3, 5, and 7 is similarly equipped with first and second tuning screws extending along orthogonal axis and a mode coupling screw extending along a third axis which is at a substantially 45° angle to the first and second axes. These screws have not been shown for the intermediate cavity 7, while they have been illustrated as 29', 31', and 33' for output cavity 5, where the primed numbers correspond to like-numbered parts in cavity 3. Screw 33' is disposed at a 45° angle to each of turning screws 29' and 31' and to provide the coupling of the four resonant orthoganol modes in cavity 5. Although the screws 29' and 31' are shown in alternative positions with respect to the central axis of the cavities, it is to be understood that their tuning function is not altered thereby, and the orthogonal first and second axes remain in the same position as in the case of input cavity 3. Coupling screw 33' orientation is shown at a 90° angular location to coupling screw 33, and while it still provides for the coupling between the two orthogonal modes in output cavity 5, the relative sign of the coupling it produces is opposite to that in the input cavity 3.

Similarly, each cavity is equipped with a coupler to couple microwave energy into and out of the cavity. With the exception of the probe assembly 13 in input cavity 3, these couplers all comprise one or another variety of iris in the embodiment of FIG. 1. However, the coupling means could be entirely capacitive probes or inductive irises or any combination of the two. Further, although irises 21 and 23 have been illustrated as cruciform in shape, such that they function as orthogonal slot irises to couple to each of the two orthogonal modes in the respective cavities, other forms of irises could be used, depending on the nature of the inter-cavity coupling required by the filter function being realized.

Figure 2:
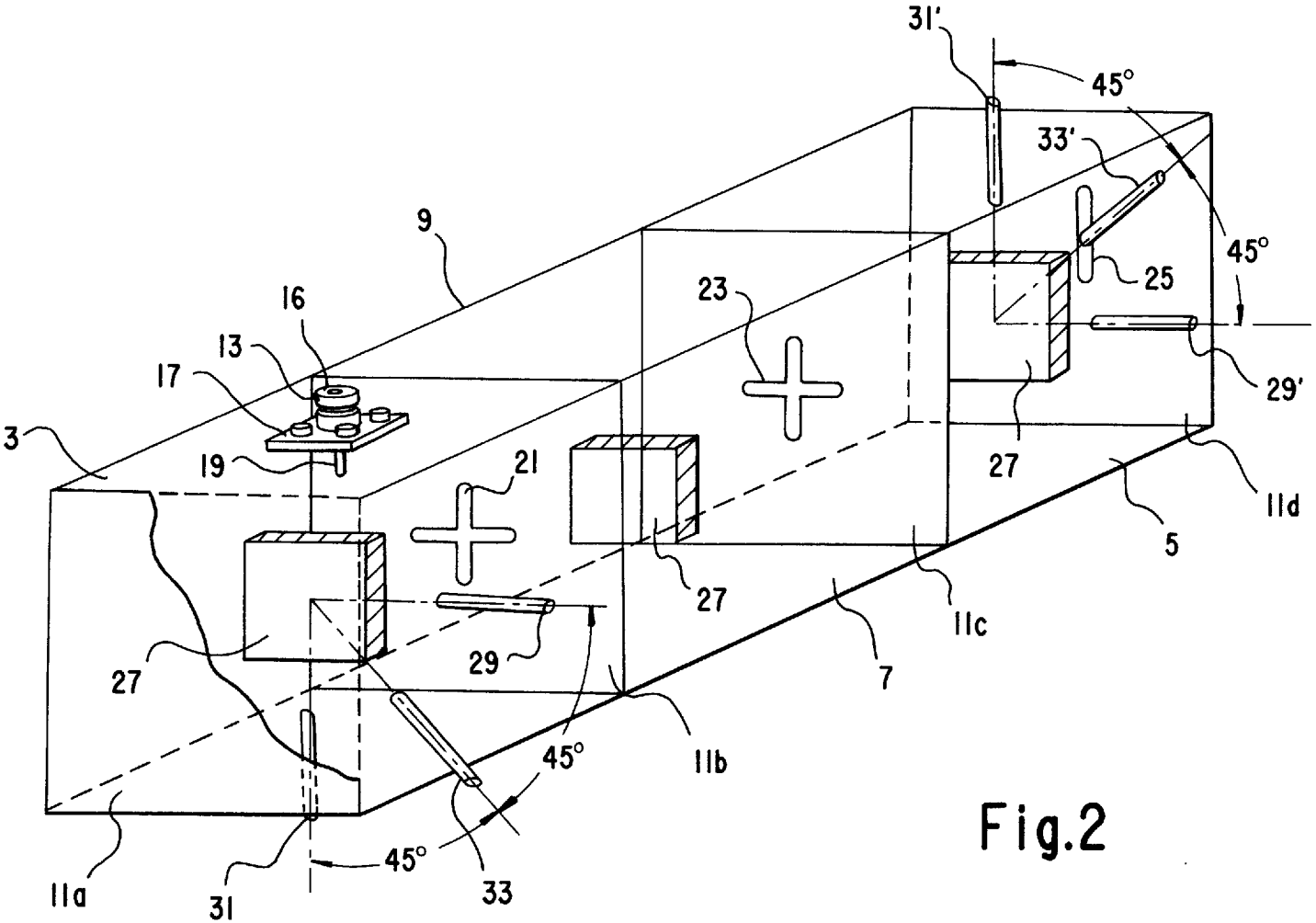
FIG. 2 is a cut-away sketch of a dual-mode multiple coupled filter illustrating a second embodiment of the present invention in a rectangular cavity structure, with rectangular cylindrical resonant conductor elements.

FIG. 2 is another possible embodiment of the invention which uses square cavities with square conductor loadings, instead of the circular cylindrical cavities and conductor loadings of FIG. 1. The functions of the cavity enclosures, loadings, tuning screws, coupling screws and coupling irises in FIG. 2 are analogous to the corresponding ones in FIG. 1. The filter of FIG. 2 is shown to comprise an input cavity 3, and output cavity 5 and one or more intermediate cavities 7. Cavities 3, 5 and 7 may all be electrically defined within a short length of a square waveguide 9 by a series of spaced transversely extending cavity end walls 11*a,* 11*b* , 11*c* and 11*d.* These end walls and the waveguide 9 may all be made of metallic or nonmetallic material such as aluminum, copper, Invar and plastic. Further, the interior surface of waveguide 9 and the surfaces of end walls 11*a,* 11*b* , 11*c* and 11*d* may be plated with a highly electrically conductive material such as silver. End walls 11*a,* 11*b* , 11*c* and 11*d* may be joined to the interior of waveguide 9 by any known brazing or soldering technique or by other bonding techniques as appropriate to the materials concerned.

An input coupling device in the form of a coaxial probe assembly 13 is used to couple microwave energy from an external source (not shown) to input cavity 3. As shown in FIG. 2, probe assembly 13 includes a coaxial connector 16, a mounting flange 17, and a capacitive probe 19. Microwave energy coupled to probe 19 is radiated therefrom into input cavity 3, where electromagnetic fields of a resonant hybrid mode ($HE_{11n}$) is excited. From input cavity 3, microwave energy is further coupled into intermediate cavities 7 by a first iris 21 of cruciform shape in end wall 11*b,* and from intermediate cavities 7 into output cavity 5, by a second iris 23, also of cruciform shape, in end wall 11*c*. Finally, energy is coupled from output cavity 5 into a waveguide system (not shown) by an output iris 25 of simple slot configuration into end wall 11*d.* Within each of cavities 3, 5 and 7 is disposed a conducting rectangular resonator element 27. The conducting resonator elements 27 can be made of a metal such as copper, aluminum or Invar, and plated with thin conductive silver, or it can be made of a superconducting material which when cooled yields very low surface resistivity. The cooling of the total filter assembler may be achieved by immersing the entire assembly in a liquid nitrogen bath (not shown). Will careful design, the composite resonators formed by the combination of cavities 3, 5 and 7 and the conductor resonator elements 27 can possess a high unloaded Q, while the effect of loading by the conductive elements 27 reduce the physical sizes of the composite resonators as compared to "empty" cavity resonators designed for the same resonant frequency.

Each composite physical resonator supports two independent modes of resonance which have identical field configurations but rotated at 90 degree angles to each other. The direction of maximum transverse electric fields of one of the resonant modes corresponds to a zero transverse filed for the orthogonal mode and vice versa. This property of the modes allows the independent fine tuning of the resonant frequency of each mode by a tuning screw oriented in the direction of its maximum electric field. Thus in FIG. 2 a first tuning screw 29 projects into input cavity 3 along a first axis, which interacts the axis of cavity 3 and resonator element 27 at a substantially 90 degree angle thereto. A second tuning screw 31 is similarly projects into cavity 3 along a second axis which is rotationally displaced from the first axis by 90 degrees. Tuning screws 29 and 31 serve to tune the resonant frequencies of the two orthogonal hybrid $HE_{11n}$ modes excited in cavity 3, along the first and second axes respectively. Since the amount of projection of screws 29 and 31 into the cavity are independently adjustable, each of the two orthogonal modes can be separately tuned to a precisely selected resonant frequency, such that physical composite cavity 3 with its resonant element 27 provide a realization of two poles of the complex filter function.

In order to provide a variable amount of coupling between the two orthogonal resonant modes in cavity 3, a third coupling screw 33 is provided extending onto cavity 3 along a third axis at an angle of 45 degree to each of tuning screws 29 and 33. Since the total tangential electric field along the direction of screw 33 must be zero, the field components from the two orthogonal modes along that direction must be equal and opposite to each other, thus creating coupling between the two mode. Furthermore the amount of such coupling can be changed by varying the amount of penetration of screw 33 into cavity 3.

Figure 3:
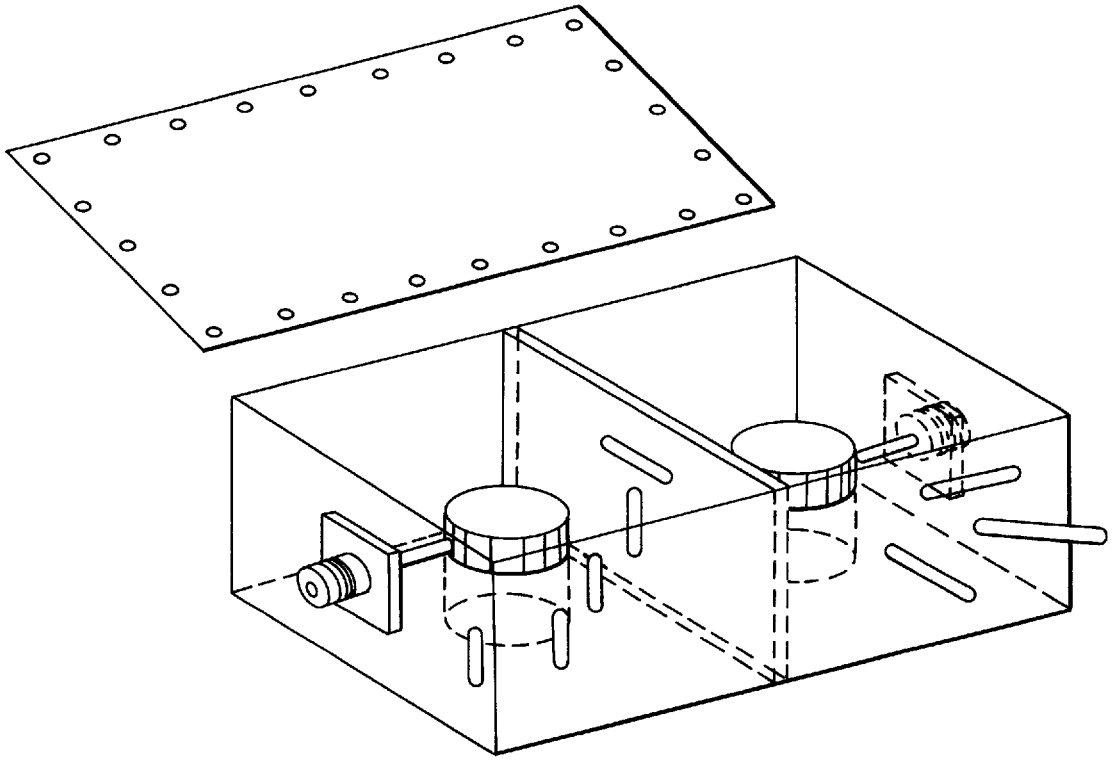
FIG. 3 is a sketch of an alternative dual mode multiple coupled filter illustrating a third embodiment of the present invention using cylindrical conductors inside a rectangular enclosure.

FIG. 3 shows a third possible embodiment of the invention, which uses circular cylindrical loading conductor inside rectangular enclosures. Again the functions of the enclosures, conductor loadings, tuning screws, coupling screws and coupling irises are analogous to those shown in FIG. 1 and FIG. 2 and will not be repeated for the sake of brevity.

FIGS. 4A and 4B show a theoretical model useful in calculating the resonant frequency of each composite resonator, such that it is possible to accurately design each of the composite resonators needed to realize a complex filter function. In these figures, the composite resonator is modeled as a conducting cylindrical post 401 having diameter 2b (see FIG. 4B) and thickness t (see FIG. 4A), coaxially surrounded by a cylindrical conducting enclosure 402 of diameter 2a (see FIG. 4B) and total length L (see FIG. 4A). The analysis of the structure is performed using the mode matching technique, in which the structure is partioned into several regions in accordance with the spatial discontinuities. The electromagnetic fields in each region are expressed as linear combinations of the eigenmode fields, which are orthogonal and constitute a complete set of the electromagnetic fields space. For the structure of FIG. 4A it is convenient to divide it into three regions:

Regional A: $0 \leqq r \leqq b, \frac{t}{2} \leqq z < \frac{L}{2}$

Region B: $b < r \leqq a; -\frac{L}{2} \leqq z \leqq \frac{L}{2}$

Region C: $0 \leqq r \leqq b; -\frac{L}{2} \leqq z \leqq \frac{t}{2}$

The parameters appearing in equations (1) to (10) below have the following definitions:

- The symbol (ˆ) appearing on any letter indicates that the combination of letter and the symbol (ˆ) represent a unit vector or a normalized vector field.
- The letters E and H indicate electric or magnetic vector field.
- The suffix A, B, or C to any field quantity indicate that the field is defined in regions A, B, or C respectively, in FIG. 4A.
- r,ϕ,z indicate the variables of a cylindrical coordinate system.
- The quantities $A_i$, $B_j$, $C_k$, indicate constant coefficients (independent of the coordinates).
- The symbols: $\hat{e}_{A_i}(\phi,z)$;$\hat{h}_{A_i}(\phi,z)$;$\hat{e}_{B_j}(\phi,z)$;$\hat{h}_{B_j}(\phi,z)$;$\hat{e}_{C_k}(\phi,z)$; and $\hat{h}_{C_k}(\phi,z)$ represent normalized vector electric or magnetic fields in the direction normal to the radial unit vector $\hat{r}$ which when multiplied by the appropriate function g, constitute solutions of the wave equation in the corresponding region (A, B, or C of FIG. 4A); i.e. the product: $\hat{e}_{A_i}(\phi,z)g^{e}_{A_i}$ are eigen functions for the electric field vectors in region A; $\zeta_{A_i}$, $\zeta_{B_j}$ and $\zeta_{C_k}$ are radial eigen values in the regions A, B, and C respectively.

The total transverse (to the $\hat{r}$ direction) electromagnetic fields in each region are expressed as linear combinations of the eigen modes in each region as $$\overline{E}_A(r,\phi,z) = \sum_{i=1}^{\infty} A_i \hat{e}_{A_i}(\phi,z) g^{e}_{A_i}(\zeta_{A_i} r) \quad (1)$$

$$\overline{H}_A(r,\phi,z) = \sum_{i=1}^{\infty} A_i \hat{h}_{A_i}(\phi,z) g^{h}_{A_i}(\zeta_{A_i} r) \quad (2)$$

$$\overline{E}_B(r,\phi,z) = \sum_{j=1}^{\infty} B_j \hat{e}_{B_j}(\phi,z) g^{e}_{B_i}(\zeta_{B_i} r) \quad (3)$$

$$\overline{H}_B(r,\phi,z) = \sum_{j=1}^{\infty} B_j \hat{h}_{B_j}(\phi,z) g^{h}_{B_j}(\zeta_{B_j} r) \quad (4)$$

$$\overline{E}_c(r,\phi,z) = \sum_{k=1}^{\infty} C_k \hat{e}_{C_k}(\phi,z) g^{e}_{C_k}(\zeta_{C_k} r) \quad (5)$$

$$\overline{H}_c(r,\phi,z) = \sum_{k=1}^{\infty} C_k \hat{h}_{C_k}(\phi,z) g^{h}_{C_k}(\zeta_{C_k} r) \quad (6)$$

where the indices i, j, k should cover all possible eigenmodes for regions A, B and C, respectively. $\hat{e}_{A_i}$, $\hat{h}_{A_i}$, $\hat{e}_{B_j}$, $\hat{h}_{B_j}$, $\hat{e}_{C_k}$, and $\hat{h}_{C_k}$ are electric and magnetic fields for the i'th, jth and kth eigenmodes in regions A, B, and C respectively. $\zeta_{Ai}$, $\zeta_{Bj}$, and $\zeta_{Ck}$ are wavenumbers in the corresponding regions. The radial eigenmode functions in each region are given by:

| Functions | TM-Modes | TE-Modes |
|---|---|---|
| $g^{e}_{A_i}(\zeta_{A_i}r)$ | $J_n(\zeta_{A_i}r)$ | $J'_n(\zeta_{A_i}r)$ |
| $g^{h}_{A_i}(\zeta_{A_i}r)$ | $J'_n(\zeta_{A_i}r)$ | $J'_n(\zeta_{A_i}r)$ |
| $g^{e}_{B_j}(\zeta_{B_j}r)$ | $J_n(\zeta_{B_j}r)Y'_n(\zeta_{B_j}a)-J'_n(\zeta_{B_j}r)Y_n(\zeta_{B_j}r)$ | $J_n(\zeta_{B_j}r)Y_n(\zeta_{B_j}a)-J_n(\zeta_{B_j}a)Y_n(\zeta_{B_j}r)$ |
| $g^{h}_{B_j}(\zeta_{B_j}r)$ | $J'_n(\zeta_{B_j}r)Y'_n(\zeta_{B_j}a)-J'_n(\zeta_{B_j}r)Y'_n(\zeta_{B_j}r)$ | $J'_n(\zeta_{B_j}r)Y_n(\zeta_{B_j}a)-J'_n(\zeta_{B_j}a)Y_n(\zeta_{B_j}r)$ |
| $g^{e}_{C_j}(\zeta_{C_j}r)$ | $J_n(\zeta C_j r)$ | $J'_n(\zeta C_j r)$ |
| $g^{h}_{C_j}(\zeta_{C_j}r)$ | $J'_n(\zeta C_j r)$ | $J_n(\zeta C_j r)$ |

$J_n$,$Y_n$ are Bessel functions of the first and second kinds respectively. $J'_n$, $Y'_n$ are the derivatives of $J_n$ and $Y_n$ respectively.

| Functions | TM-Modes | TE-Modes |
|---|---|---|
| $\beta_{A_i} = \beta_{C_i}$ | $2\pi(i-1)/(L-t)$ | $2\pi i/(L-t)$ |
| $\hat{e}A_i(\phi,z) = eC_i(\phi,z)$ | $\frac{n\beta_{A_i}}{\zeta^2_{A_i}r}\sin n\phi \sin\beta_{A_i}z\hat{a}_\phi + \cos n\phi\cos\beta_{A_i}z\hat{a}_z$ | $\frac{1}{\zeta_{A_i}}\sin n\phi\sin\beta_{A_i}z\hat{a}_\phi$ |
| $ja_i\mu\hat{h}_{A_i}(\phi,z) = ja_i\mu\hat{h}_{C_i}(\phi,\zeta)$ | $\frac{\omega^2\mu_0\epsilon_0}{\zeta^2_{A_i}}\cos n\phi\cos\beta_{A_i}z\hat{a}_\phi$ | $\frac{n\beta^2_{A_i}}{\zeta^2_{A_i}}\cos n\phi\cos\beta_{A_i}z\hat{a}_\phi + \sin n\phi\sin\beta_{A_i}\zeta\hat{a}_\zeta$ |
| $\zeta^2_{Ai} = \zeta^2_{Ci}$ | $\omega^2\mu_0\epsilon_0 - \beta^2_{Ai}$ | $\omega^2\mu_0\epsilon_0 - \beta^2_{Ai}$ |
| $\hat{e}_{B_i}(\phi,z)$ | $\frac{n\beta_{B_i}}{\zeta^2_{B_i}r}\sin n\phi\sin\beta_{B_i}z\hat{a}_\phi + \cos n\phi\cos\beta_{B_i}z\hat{a}_\zeta$ | $\frac{1}{\zeta_{B_i}}\sin n\phi\sin\beta_{B_i}z\hat{a}_\phi$ |
| $\hat{e}_{Bi}(\phi,z)$ | $\frac{w^2\mu_0\epsilon_0}{\zeta^2_{B_i}}\cos n\phi\cos\beta_{B_i}z\hat{a}_\phi$ | $\frac{\omega^2\mu_0\epsilon_0}{\zeta^2_{B_i}}\cos n\phi\cos\beta_{B_i}z\hat{a}_\phi$ |
| $\beta_{B_i}$ | $\pi(i-1)/L$ | $\pi i/L$ |
| $\zeta^2_{B_i}$ | $\omega^2\mu_0\epsilon_0 - \beta^2_{Bi}$ | $w^2\mu_0\epsilon_0 - \beta^2_{B_i}$ |

Where $\beta_{Ai}$, $\beta_{Bi}$ and $\beta_{Ci}$ are the eigen values of a parallel plane waveguide in the z-direction for regions A, B, and C respectively. ($\omega$ is the angular frequency, $\mu$., $\epsilon$, are the permeability and permitivity in free space respectively. $\hat{a}\phi$ is the unit vector in the $\phi$-direction; $\hat{a}_z$ is the unit vector in the z-direction; n is the azimuthal field variation index indicating the number of field variations in the $\phi$-direction.

By matching the boundary conditions at r=a the following equations are obtained.

$$\bar{E}_A(r=a,\phi,z)=\bar{E}_B(r=a,\phi,z)\Rightarrow$$

$$\sum_{i=1}^{\infty} A_i\hat{e}_A(\phi,z)g^e_{A_i}(\zeta_{A_i}a)=\sum_{j=1}^{\infty} B_j\hat{e}_{B_j}(\phi,z)g^e_{B_j}(\zeta_{B_j}a) \tag{7}$$

By defining an appropriate inner product and applying orthogonality properties, a set of linear equations is obtained:

$$\sum_{j=1}^{\infty} \lambda_{ij}B_j=0 \tag{8}$$

where $$\lambda_{ij}=<\hat{e}_{B_j},\hat{h}_{A_i}>g^e_{B_j}(\zeta_{B_j}a)g^h_{A_i}(\zeta_{A_i}a) \tag{9}$$

and $$<\hat{e}_p,\hat{h}_q>=\int_0^{2\pi}\int_0^L \hat{e}_p\times\hat{h}_q\cdot\hat{r}dzd\phi \tag{10}$$

p and q stand for $A_i$ and $B_j$ respectively; $\hat{r}$ is the unit vector in the r-direction.

Equations (8) constitute a homogenous linear system. For the existence of nontrivial solutions to the linear system (8) the determinant of the matrix of the system has to be zero, that is:

$$\det \Lambda=0 \tag{11}$$

where det indicates the determinant of the matrix that follows.

The frequencies satisfying (11) are the resonant frequencies of the structure.

Similar calculations apply to the shapes shown in FIGS. 4C, 4D, 5A, 5B, 6A, and 6B.

FIG. 4C depicts a cylindrical enclosure 402 loaded with a metallic ring element 401. FIG. 4D is a cross section side view of FIG. 4C, showing the diameters of the loading ring element 401 and enclosure 402. the use of a ring loading element serves two purposes; it reduces the weight of the resonator, and it can improve the spurious response of the resonator.

FIG. 5A depicts a rectangular enclosure 402 loaded with a solid metallic rectangular element 401. FIG. 5B is a cross section side view of FIG. 5A. The use of rectangular enclosure and loading elements can provide advantages in manufacturing and packaging.

FIG. 6A depicts a rectangular enclosure 402 loaded with a solid metallic cylindrical element 401. FIG. 6B is across section side view of FIG. 6A showing the loading element 401 supported by a low dielectric constant rod support 403. the loading elements 401 in FIGS. 5A, 5B, 6A and 6B can be made as rings by having a hole in their centers for weight reduction purposes and possible improvement of the spurious response of the resonator.

Figure 8:
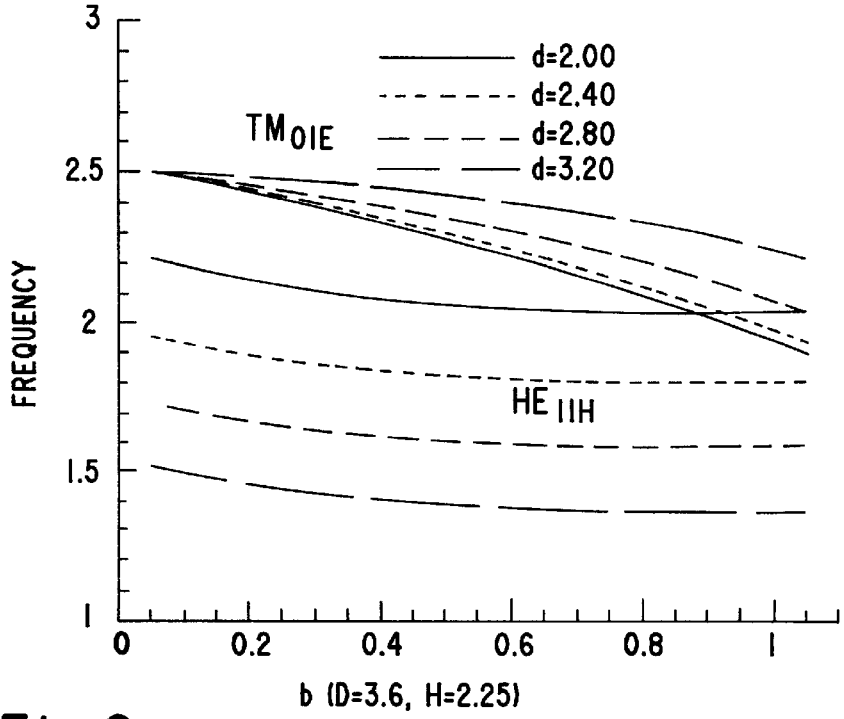
FIG. 8 is a representative graph useful for the design of the filters, showing the computed resonant frequencies of a metallic loaded resonator as a function of the dimensional parameters of the resonator structure.
Figure 9:
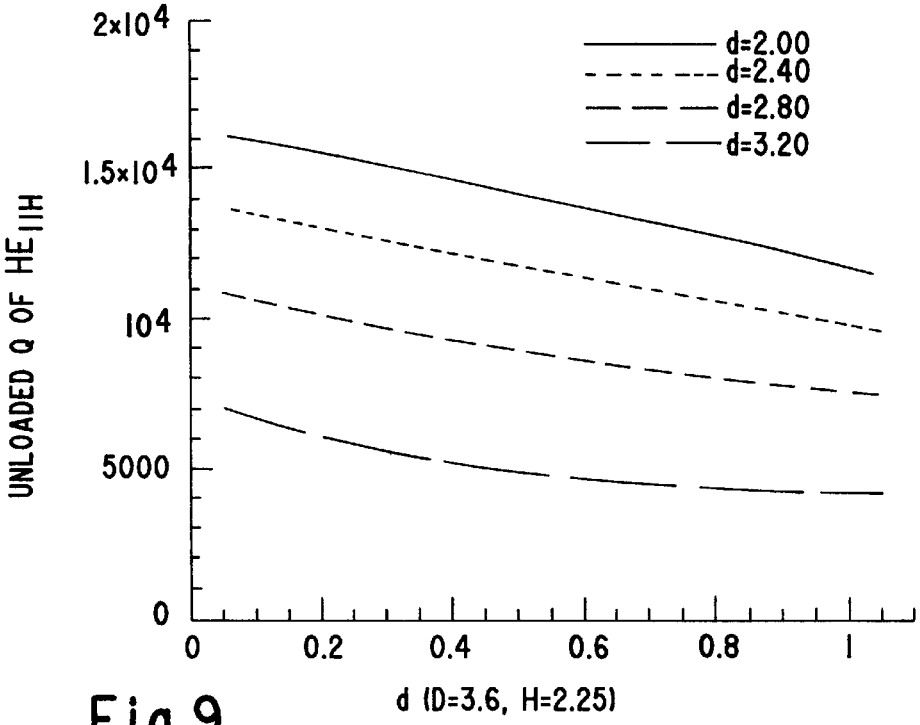
FIG. 9 is a graph showing the computed unloaded Q's for the structures of FIG. 1.

Computer programs have been developed to perform the numerical analyses of the conductor loaded resonators. Typical results which can be used in the design of resonators are shown in FIG. 8 which shows the computed resonant frequency for the $TM_{01E}$ and $HE_{11H}$ modes of a resonator with b=1.8" and L=2.25", as a function of the thickness t and the metallic loading disk diameter d=2a. FIG. 9 shows the computed unloaded Q for the same parameters as shown in FIG. 8, with a copper metallic enclosure and conductor loading at room temperature. For cooled superconductors, the values of these unloaded Q's would be multiplied by a factor of at least 10.

Figure 10:
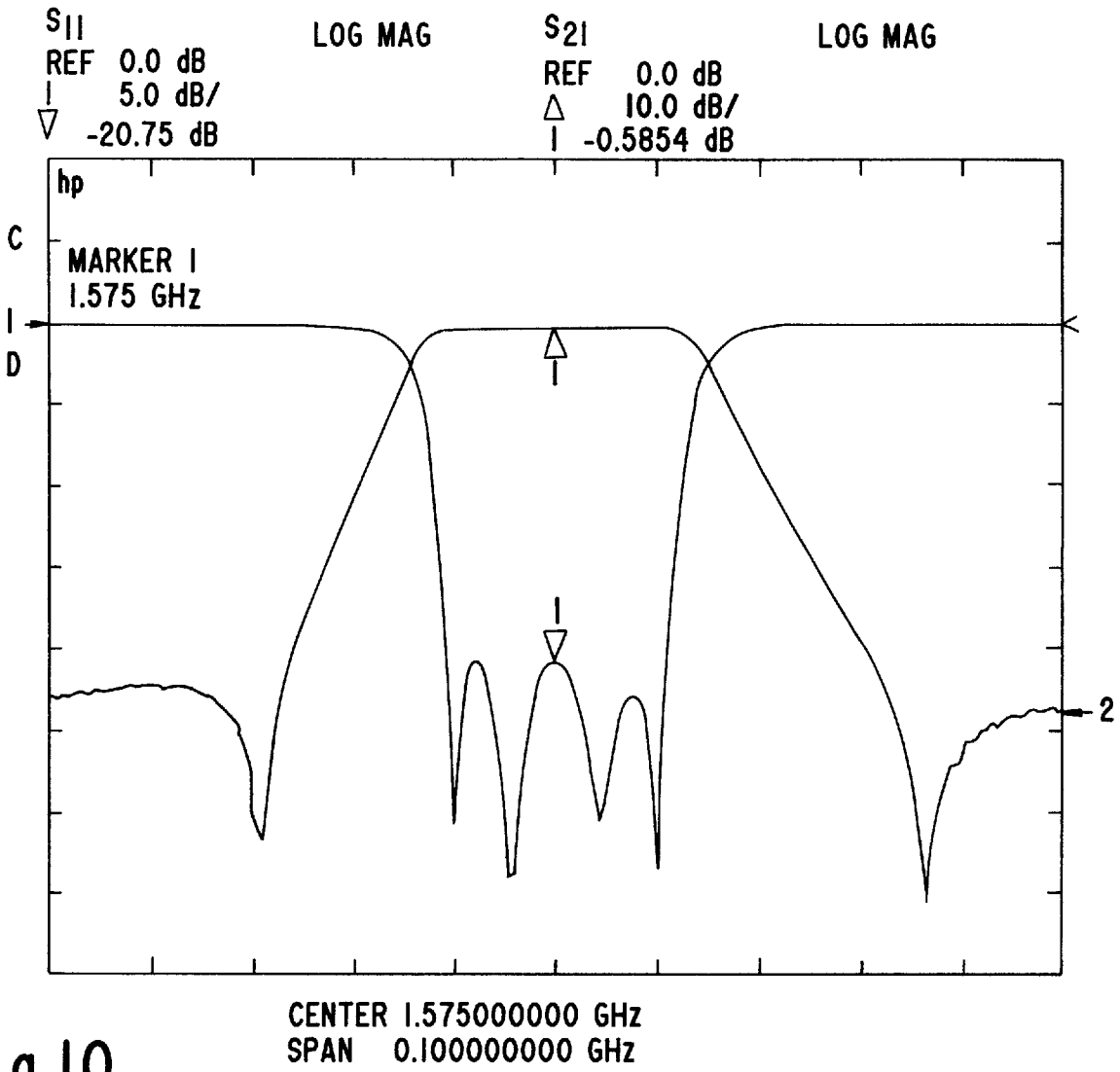
FIG. 10 is a measured frequency response of a 4-pole elliptic function band pass filter realized in the configuration of FIG. 1, according to the teaching of the present invention.

To verify the invention ideas experimentally a 4-pole elliptic function filter was designed, constructed according to the embodiment of FIG. 1 and tested. Test results showing the frequency response of the insertion loss and return loss of the experimental filters are shown in FIG. 10. The response shows an excellent agreement with the theoretical design. The mid-band insertion loss of this filter whose enclosure is made of aluminum and the metallic loading disk is made from copper, is about 0.6 dB indicating a realized very high Q of about 7,000. If the enclosure and the center metallic loading disk are made of superconducting material, the loss is expected to be one-tenth of the measured loss or about 0.06 dB. The total size of this filter is approximately only 3.6" diameter 4.5" long. A major advantage of this filter is its wide band spurious free response.

Figure 11:
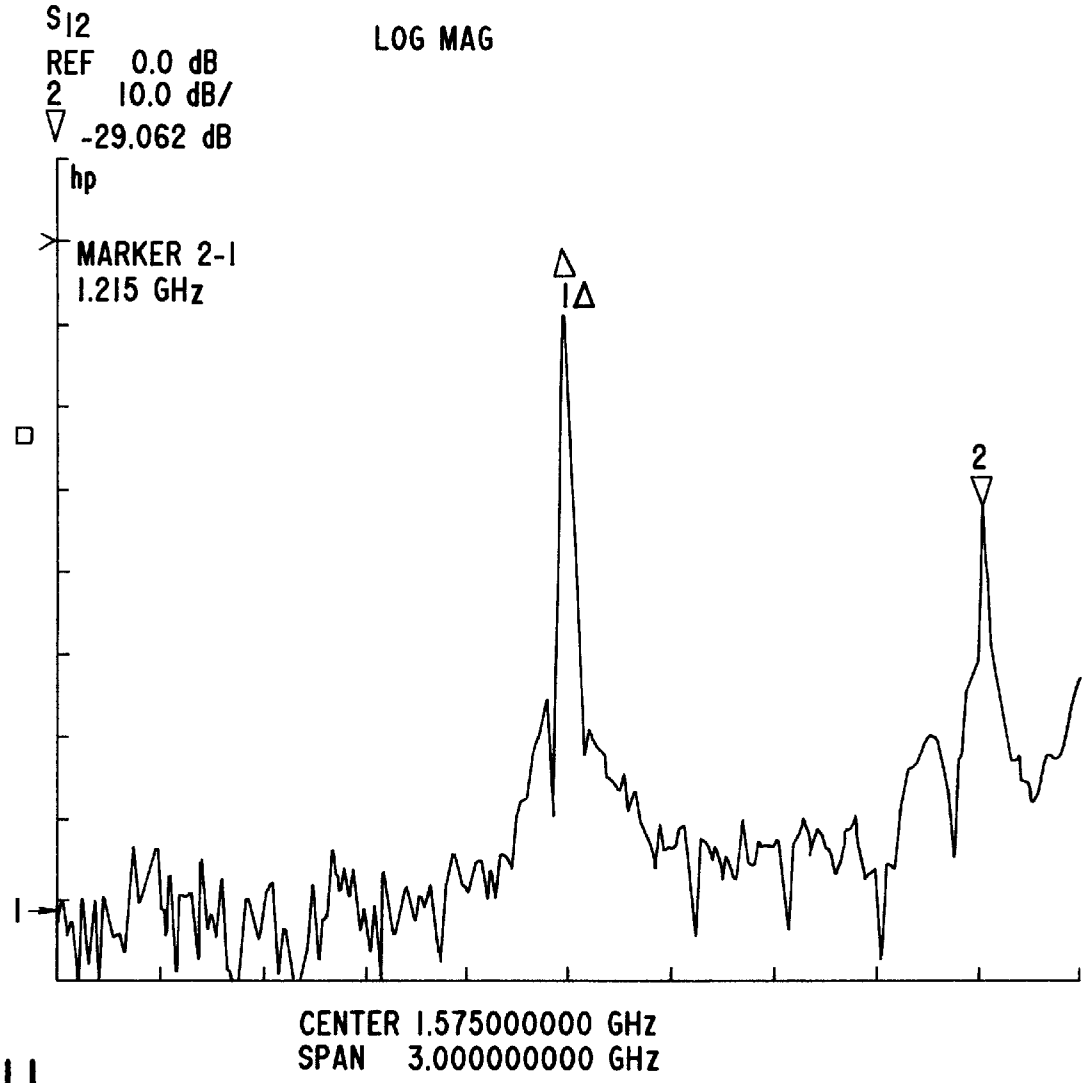
FIG. 11 shows a wideband frequency response of the filter.

FIG. 11 illustrates this advantage by showing the wide-band frequency response of the filter. The first higher order mode spurious occurs at 1.21 GHz away from the center frequency or approximately at twice the center frequency. This is much larger than either empty waveguide resonators or dielectric loaded resonators, whose spurious modes would be observed as close as about 200 MHz away from the center frequency of such filter.

Although the invention of this application has been described with some particularity by reference to a set of preferred embodiments, it will be readily apparent to those skilled in the art who have reviewed this disclosure that many changes could be made and many apparently different embodiments thus derived without departing from the scope of the invention. For example, although the invention has been concentrating on an embodiment which utilizes cylindrical resonators cavities and the $HE_{111}$ mode of the conductor loaded resonator, the invention is not limited to this geometry. In fact, other configurations, such as a square cross section normal to the composite resonator axis, could be used for either the metallic loading element or the cavity or both, as shown in FIG. 2 and FIG. 3. Furthermore, the metallic loading element could be a ring, or doughnut shaped object instead of a cylindrical post, to further improve the spurious response and increase the unloaded Q. Also, higher order modes such as the $HE_{11n}$ where n is an integer greater than 1 (2, 3, or 4) could also be used to obtain, for example, higher Q's. Consequently, it is intended that the scope of the invention be interpreted only from the appended claims.

What is claimed is:

1. A miniaturized microwave filter comprising in combination:

(a) a first composite microwave resonator comprising (i) a cavity resonator and (ii) disposed within said cavity resonator, a loading element of a conducting material;

(b) first tuning means for tuning said composite microwave resonator to resonance at a first frequency along a first axis;

(c) second tuning means for tuning said composite microwave resonator to resonance at a second frequency along a second axis orthogonal to said first axis;

(d) mode coupling means for causing mutual coupling and excitation between resonant electromagnetic fields on said first and second axes;

(e) input means for coupling microwave energy into said cavity resonator; and (f) output means for coupling a portion of one of said resonant electromagnetic fields on said first and second axes out of said cavity resonator.

2. The filter of claim 1, wherein said cavity resonator is a cylindrical cavity having a cavity axis, said first and second axes intersect the cavity axis of said cylindrical cavity, and said resonator loading element is disposed on said cavity axis.

3. The filter of claim 2, wherein said loading element is in a shape taken from the group consisting of cylindrical, ring, and doughnut shapes and is disposed with an axis substantially collinear with said cavity axis.

4. The filter of claim 1, wherein said respective resonances on said first and second axes are resonances in a corresponding $HE_{111}$ mode.

5. The filter of claim 1, wherein said conducting material comprises a super conductor material.

6. The filter of claim 1, wherein said first tuning means is adjustable to vary selectably the first frequency.

7. The filter of claim 6, wherein said first tuning means comprises an adjustable susceptance extending along said first axis from a wall of said cavity resonator toward said loading element.

8. The filter of claim 7, wherein said adjustable susceptance comprises a tuning screw extending through said wall of said cavity resonator.

9. The filter of claim 1, wherein said mode coupling means comprises an adjustable susceptance disposed along a third axis substantially equi-angularly spaced from said first and second axes.

10. The filter of claim 9, wherein said mode coupling means comprises a mode coupling screw extending through a wall of said cavity resonator toward said loading element along said third axis, and wherein said third axis is angularly spaced from each of said first and second axes by substantially 45°.

11. The filter of claim 1, wherein the loading element comprises metal.

12. The filter of claim 11, wherein the metal is silver-plated copper.

13. The filter of claim 11, wherein the metal is aluminum.

14. The filter of claim 11, wherein the metal is a superconducting metal.

15. A microwave filter comprising, in combination:

(a) a first resonator having (i) a first cavity and (ii) disposed within said first cavity, a first conducting loading element made of a first conducting material;

(b) a second resonator having (i) a second cavity and (ii) disposed within said cavity, a second conducting loading element made of a second conducting material;

(c) first tuning means in said first resonator for tuning said first resonator to resonance at a first frequency along a first axis;

(d) second tuning means in said first resonator for tuning said first resonator to resonance at a second frequency along a second axis;

(e) third tuning means in said second resonator for tuning said second resonator to resonance at a third frequency along a third axis;

(f) fourth tuning means in said second resonator for tuning said second resonator to resonance at a fourth frequency along a fourth axis orthogonal to said third axis;

(g) first mode coupling means in said first resonator for causing mutual coupling between resonant electromagnetic fields along said first and second axes;

(h) second mode coupling means in said second resonator for causing mutual coupling between resonant electromagnetic fields along said third and fourth axes;

(i) input means in said first resonator for coupling microwave energy into said first resonator; and (j) output means in said second resonator for coupling said microwave energy out of said second resonator;

said first and second resonators sharing a common wall which has an iris means for coupling resonant energies along said first and second axis from said first to said second resonator.

16. The filter of claim 15, wherein at least one of the first and second conducting materials comprises a superconducting material.

* * * * *